US005975804A

United States Patent [19]

Bockman

[11] Patent Number: 5,975,804

[45] Date of Patent: Nov. 2, 1999

[54] TILE PLOW

[75] Inventor: Richard Bockman, Terril, Iowa

[73] Assignee: Bockman Enterprises, Inc., Terril, Iowa

[21] Appl. No.: 08/826,478

[22] Filed: Mar. 27, 1997

[51] Int. Cl.[6] ..... F16L 1/02

[52] U.S. Cl. ..... 405/180; 405/174; 37/367

[58] Field of Search ..... 405/154, 174, 405/175, 178, 179, 180, 181, 182, 183; 37/366, 367; 172/677, 679, 680, 684.5

[56] References Cited

U.S. PATENT DOCUMENTS

| | | | |
|---|---|---|---|
| 2,601,296 | 6/1952 | Johnson | 172/680 |
| 2,909,134 | 10/1959 | Kniefel | 405/181 |
| 3,083,542 | 4/1963 | Summers et al. | 405/180 |
| 3,394,559 | 7/1968 | Kinnan | 405/183 |
| 3,400,542 | 9/1968 | Davis . | |
| 3,421,329 | 1/1969 | Kinnan . | |
| 3,431,741 | 3/1969 | Kinnan . | |
| 3,571,956 | 3/1971 | Heiberg | 37/367 |
| 3,664,141 | 5/1972 | Wyatt . | |
| 3,684,030 | 8/1972 | Lucero | 405/180 |
| 3,747,357 | 7/1973 | Erickson et al. . | |
| 3,789,614 | 2/1974 | Rogers | 405/182 |
| 3,912,018 | 10/1975 | Brundage et al. | 172/680 |
| 3,935,712 | 2/1976 | Erickson et al. . | |
| 3,952,810 | 4/1976 | Ulrich | 172/40 |
| 4,079,593 | 3/1978 | Flippin . | |
| 4,140,425 | 2/1979 | Flippin | 405/181 |
| 4,647,252 | 3/1987 | Floy | 405/174 |
| 4,741,646 | 5/1988 | Hatch | 405/179 |
| 5,855,245 | 1/1999 | Gerein | 172/677 |

FOREIGN PATENT DOCUMENTS

| | | |
|---|---|---|
| 878834 | 8/1971 | Canada . |
| 77 15620 | 5/1977 | France . |

OTHER PUBLICATIONS

Johnson Drainage Plows Advertisement, Farm Equipment Guide. Hurricane Side–Arm Advertisement. (undated).

*Primary Examiner*—David Bagnell
*Assistant Examiner*—Frederick L. Lagman
*Attorney, Agent, or Firm*—Zarley, McKee, Thomte, Voorhees & Sease

[57] ABSTRACT

A tile plow includes a horizontal beam and a shoe extending downwardly from the beam. The beam and shoe are supported on a rear wheel assembly, and a front linkage assembly. The beam and shoe are movable between a raised transport position and a lowered plowing position. The position of the rear wheel assembly and front linkage assembly is controlled by a slave hydraulic system for simultaneously raising and lowering the tile plow. A secondary hydraulic outlet adjusts the rear hydraulic cylinders relative to the front hydraulic cylinders. When the tile plow is laying a tile line, the rear wheels are positioned substantially behind the shoe.

16 Claims, 7 Drawing Sheets

TILE PLOW

BACKGROUND OF THE INVENTION

1. Field of the Invention

The present invention relates to tile plows. More particularly, though not exclusively, the present invention relates to an apparatus and method for laying tile lines which improves over the prior art.

2. Problems in the Art

Most prior art tile plows are designed to attach to the three point hitch of a tractor. The prior art tile plow typically includes a shoe positioned behind the three point hitch and a pair of wheels connected to the tile plow and located in front of the shoe.

Prior art tile plows have various problems. When farmers buy high horsepower tractors, it is common to purchase the tractor without a three point hitch because that optional feature can add thousands of dollars to the cost of the tractor. In order for a user to use a prior art tile plow which attaches to a three point hitch, the user would have to purchase the expensive optional three point hitch. In addition, heavy equipment such as a tile plow, which is attached to the three point hitch may take a number of hours to attach and detach. Some prior art three point hitch plows are attached to a pull cart, then hooked to the tractor with a pin. With such plows, the weight distribution is changed and the tractor loses traction.

Prior art tile plows have wheels which are positioned in front of, or even with, the shoe. When the wheels go over any uneven terrain, the plow shoe will change its grade in accordance with the uneven ground. Therefore, a precise tile grade is very difficult to maintain with a prior art tile plow. In addition, when a tile plow encounters a large rock, the rock must be removed by a back hoe or the like. However, a prior art tile plow with the wheels in front of or even with the shoe, the wheels get in the way of the back hoe. It is therefore difficult to remove the rock which is blocking the plow. In addition, with the wheels in front of the shoe, an upward force may be applied to the tractor which reduces traction.

Prior art tile plows also include wheel assemblies and linkage arms that often cause clearance problems. The linkage arms are intended to keep the pitch constant. However, the linkage arms can obstruct the soil flow around the shoe of the plow. Also, with prior art tile plows, pitch adjustments are typically done manually.

Another problem encountered with prior art tile plows is in laying tile in the trench dug by the tile plow. To lay the tile evenly, it is important that the tile lay at the bottom of the trench. However, sometimes the tile will be raised slightly from the bottom of the trench due to dirt filling in underneath the tile. In addition, rocks falling into the trench on top of the tile will sometimes dent the plastic tile.

Another major disadvantage of a prior art tile plow is that if an existing tile line is cut while laying a new tile line, there is no way for the user to determine that the line was cut.

Therefore, it can be seen there is a need for an effective and improved tile plow.

Features of the Invention

A general feature of the present invention is the provision of an improved method and apparatus for laying tile lines which overcomes problems found in the prior art.

A further feature of the present invention is the provision of a method and apparatus for laying tile lines which uses a tile plow attached to the draw bar of a tractor which includes a wheel assembly disposed behind the shoe of the tile plow.

Further features, objects and advantages of the present invention include:

An apparatus and method for laying tile lines which includes a horizontal beam connected between the tractor and the wheel assembly.

A method and apparatus for laying tile lines which includes a tile plow having height adjustment hydraulic cylinders at the front and back of the tile plow for raising and lowering the tile plow while maintaining the horizontal orientation of the beam.

An apparatus and method for laying tile lines which includes the use of the tile plow having a wheel assembly which is disposed behind the shoe of the tile plow and has a substantially wide wheel span.

An apparatus and method for laying tile lines which includes a master/slave hydraulic system as well as a means for adjusting the cylinders relative to each other.

An apparatus and method for laying tile lines using a plow shoe with a very narrow profile to reduce the disturbance of soil by the tile plow.

An apparatus and method for laying tile lines which includes cutting edge extensions for identifying when an existing tile line is cut by bringing debris to the surface.

An apparatus and method for laying tile lines which includes a flexible flap attached to the rear of the shoe of the tile plow for holding the tile firmly in the trench while allowing dirt to filter slowly around the tile and preventing rocks from denting the tile as the dirt falls into the trench.

An apparatus and method for laying tile lines which includes a disc coulter for breaking up debris in front of the shoe.

These as well as other features, objects and advantages of the present invention will become apparent from the following specification and claims.

SUMMARY OF THE INVENTION

The tile plow of the present invention is used to efficiently and accurately lay tile lines in a field. The tile plow is comprised of an elongated beam having a front and a back end, a shoe coupled to the beam for creating a trench, a channel formed in the shoe for receiving tile and guiding the tile into the trench created by the shoe, and a wheel assembly pivotally coupled to the back end of the beam such that the tile plow can move between a raised position and a lowered position when the wheel assembly is pivoted relative to the beam, wherein the wheel assembly is positioned substantially behind the shoe when the tile plow is in the lowered position.

The invention may optionally be controlled by front and back hydraulic cylinders coupled to the beam for adjusting the height of the tile plow. Power can be supplied to the hydraulic cylinders by a primary hydraulic outlet. A secondary hydraulic outlet may be used to adjust the rear hydraulic cylinders relative to the front hydraulic cylinders.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalencies which may be included within the spirit and scope of the invention.

Figure 1:
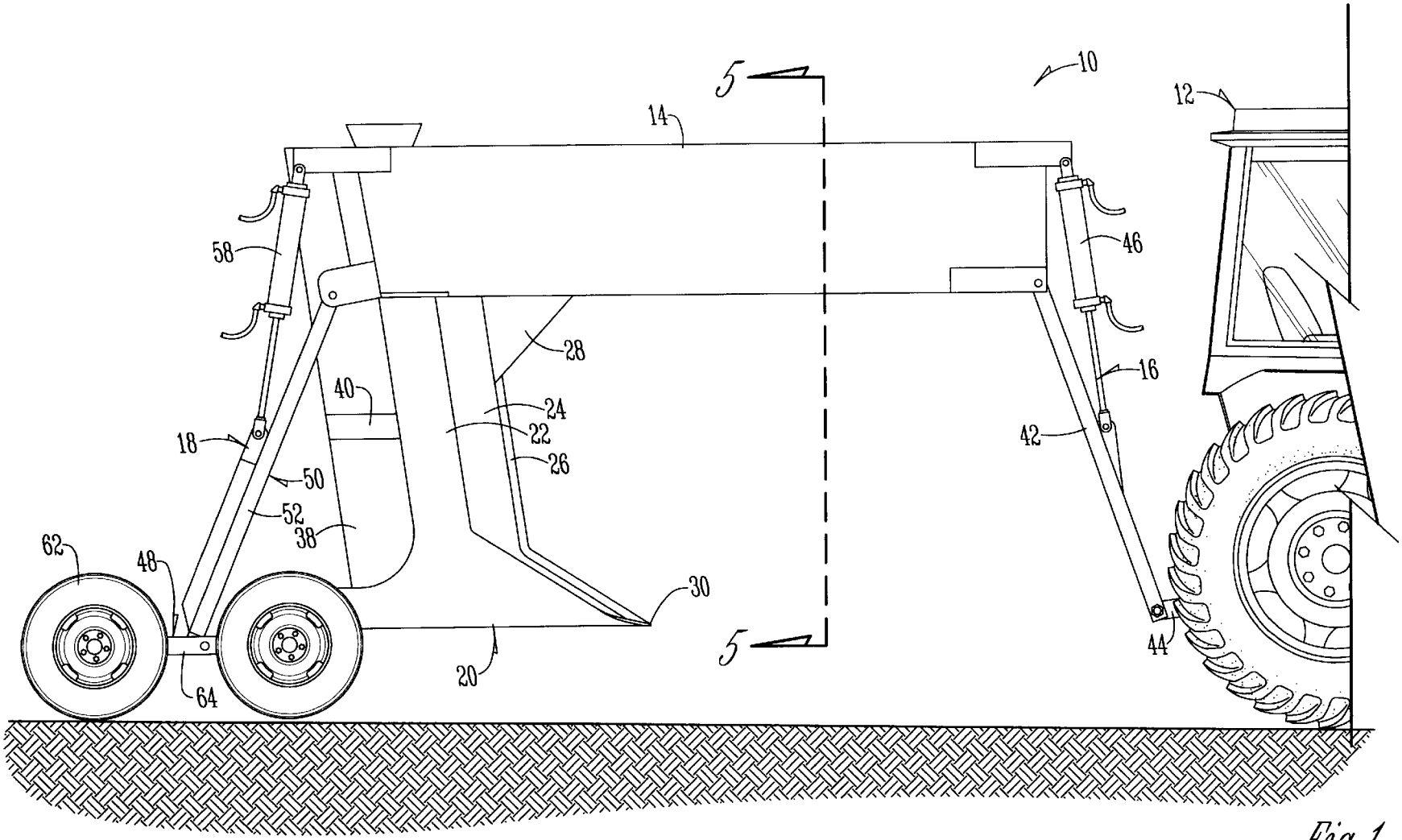
FIG. 1 is a side view of the tile plow of the present invention hitched to a tractor in a raised transport position.
Figure 2:
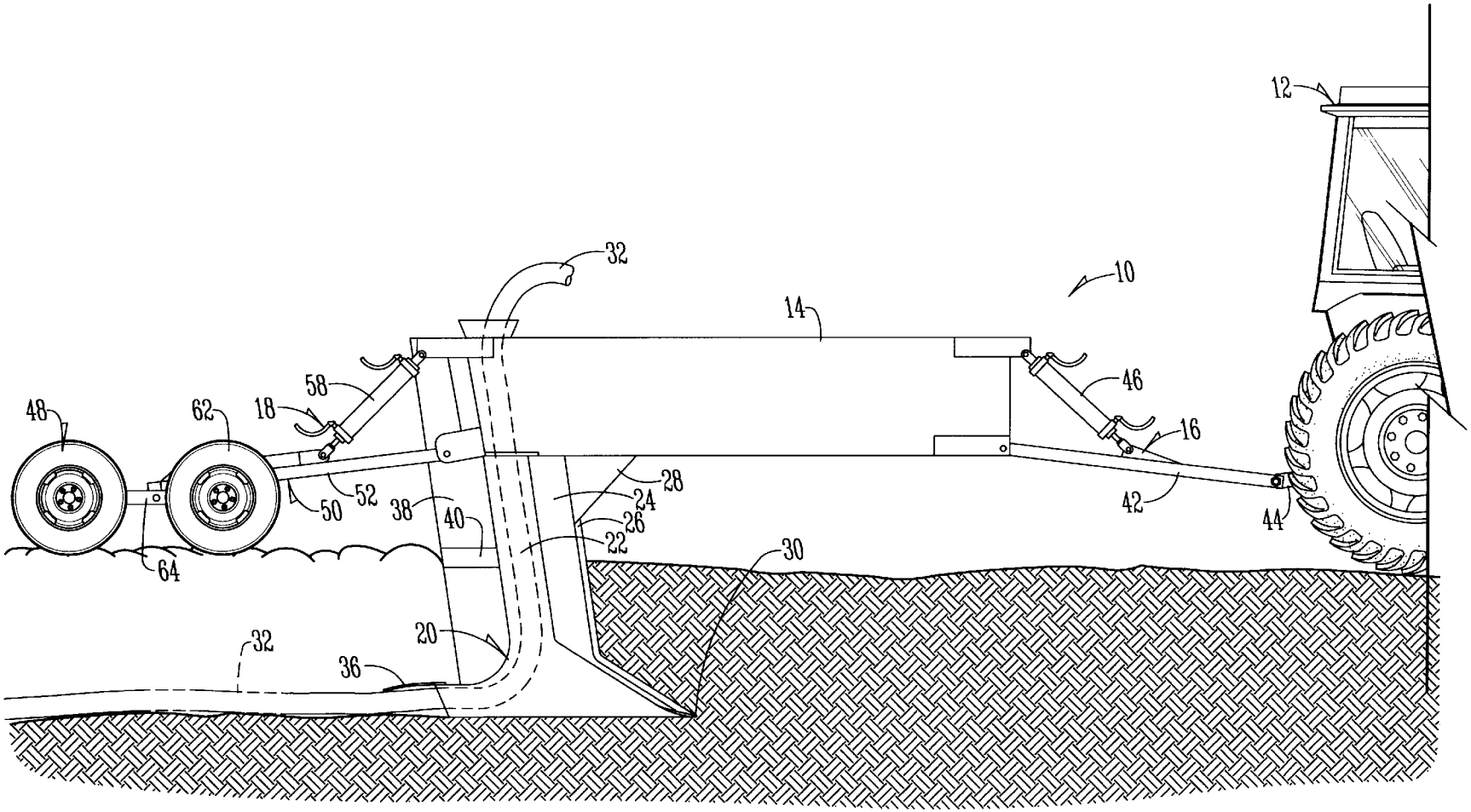
FIG. 2 is a side view of the tile plow of the present invention attached to a tractor in a lowered plowing position, with a tile shown in broken lines.

FIGS. 1 and 2 show a tile plow 10 of the present invention hitched to the drawbar of a tractor 12. The tile plow 10 is movable between a first, raised position (FIG. 1) and a second, lowered position (FIG. 2). The tile plow 10 is comprised of a beam 14 pivotally coupled to a front portion 16 and a rear portion 18. Rigidly mounted to the beam 14 is a shoe 20. As shown, the shoe 20 extends downward from the beam 14 at its trailing end. The upper portion of the shoe 20 includes a main vertical tube 22 at its trailing portion which is hollow and has a generally rectangular cross section. Just ahead of the vertical tube 22 is a slanted front portion 24 which slants inward from the vertical tube 22 to the front of the shoe 20. The slanted front portion 24 has a generally triangular cross section. The front portion 24 of the shoe 20 includes a blade 26 which is preferably comprised of a strip of quarter inch steel which forms the front edge of the shoe 20. As shown, the shoe angles forward slightly. The angle of the shoe creates a lifting action on the dirt as the shoe 20 moves through the ground.

A wedge 28 is coupled to the beam 14 and the front portion 24 of the shoe 20. The wedge 28 has a generally triangular cross section with the point of the triangle shape being the leading edge of the wedge 28. In this way, the wedge 28 serves the purpose of pushing soil outward as the tile plow 10 moves through a field.

Figures 3, 5:
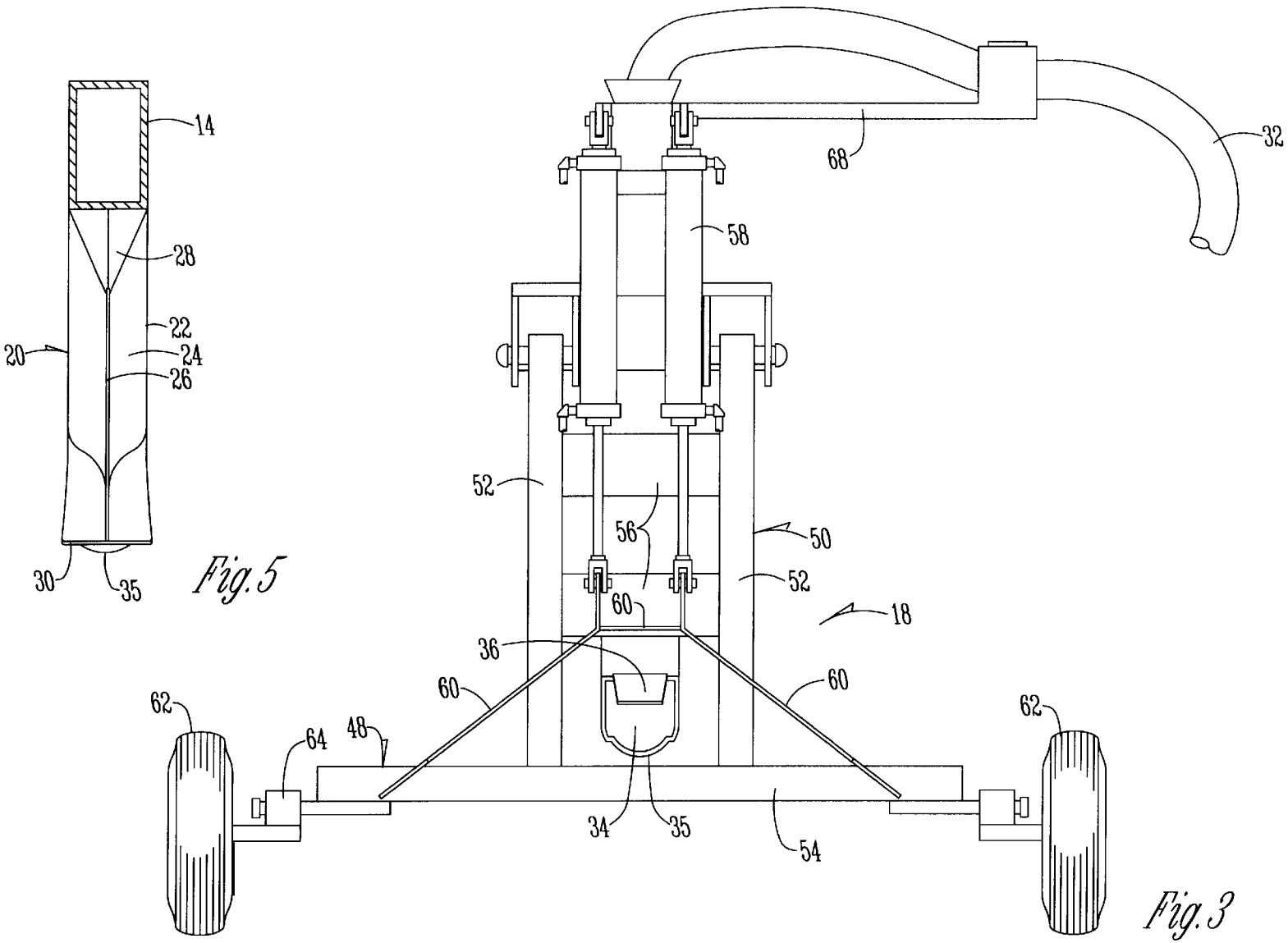
FIG. 3 is a rear view of the tile plow of the present invention.
FIG. 5 is a front elevation view taken along lines 5—5 of FIG. 1.

The leading edge of the shoe 20 comes to a point where a cutting edge 30 is formed. The cutting edge 30 is preferably 10 inches long, 8 inches wide, and is nearly horizontal in orientation. The cutting edge 30 angles only slightly downward (preferably about 15 degrees from the horizontal) in the direction of movement of the tile plow 10 which greatly reduces the power required to pull the plow 10. FIG. 5 shows a front view of the shoe including the cutting edge 30. For clarity, FIG. 5 only shows the beam 14 and shoe 20. The flat angle of the cutting edge 30 and the weight transfer created by the position of the wheels 62 allow the plow 10 to be pulled much easier than prior art plows.

A hollow channel is formed through the shoe 20 and the beam 14, as shown in FIG. 2, for allowing plastic tile 32 to be fed through the beam 14 and shoe 20. The tile 32 exits the shoe 20 at the opening 34 which has a rounded lower surface 35 as shown in FIGS. 3 and 5 which by clearing dirt, provides a trench with a curved bottom.

Coupled to the shoe 20 near the opening 34 is a flexible flap 36 (FIGS. 2 and 3) which is preferably comprised of two layers of material. The upper layer of material is preferably comprised of rubber belting which is used for strength. The bottom layer is preferably comprised of plastic so that the flap 36 can easily slide over the tile 32. The flap 36 holds the tile firmly in the trench while allowing dirt to filter slowly around the tile as the tile plow 10 moves through the field. The flap 36 also prevents rocks from denting the plastic tile 32 as the dirt and rocks fall into the trench. The flexible flap 36 is preferably six inches wide and eighteen inches long.

The trailing edge of the shoe 20 is formed by a quarter inch steel sheet 38 which extends along the back of the shoe 20 and beam 14. A brace 40 comprised of a 2×2 inch steel tube helps to strengthen the sheet 38. The sheet 38 provides strength to the tile plow 10 but also divides the trench dug by the shoe 20 in half so that large dirt clods or rocks cannot fall into the trench until the sheet 38 has passed the trench. This help to prevent damage to the tile 32 by debris falling onto the tile 32.

The beam 14 and shoe 20 have narrow profiles. Preferably, the beam 14 is eight inches wide and has a rectangular cross section. FIG. 5 shows a cross-sectional view of the beam 14. Alternatively, an I-beam could be used. Since the beam 14 is narrow, when dirt comes up the shoe 20 during use, the wedge 28 is able to push the dirt aside from the beam 14. There is nothing which allows the dirt to build up on the shoe 20 or the beam 14 unlike prior art tile plows. The trench dug by the tile plow 10 is about 8 inches wide in the preferred embodiment.

Figure 4:
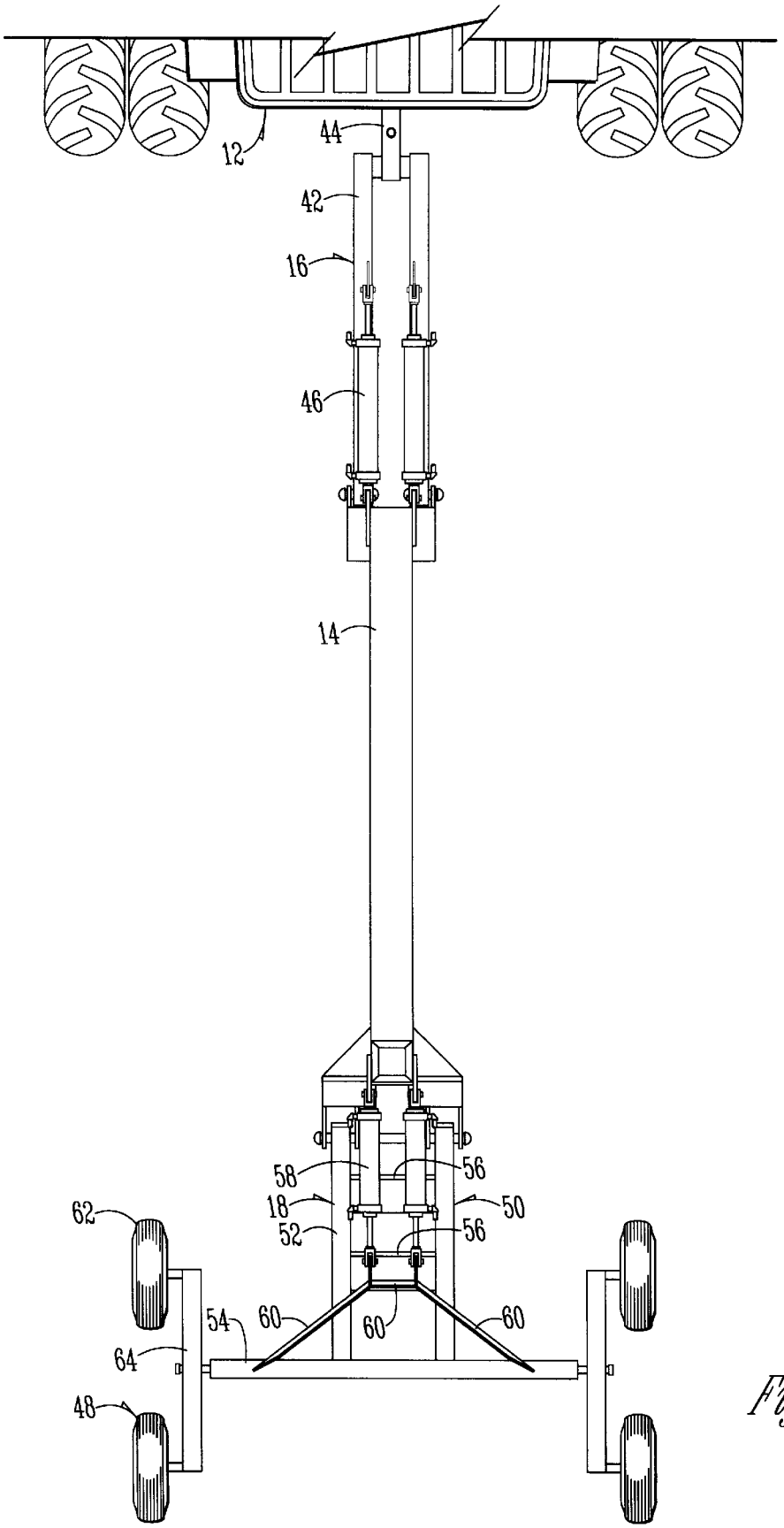
FIG. 4 is a top view of the tile plow of the present invention, with the tile roll removed for clarity.

The front portion 16 of the tile plow 10 is best shown in FIGS. 1, 2 and 4. The front portion 16 includes two parallel hitch beams 42 which form a front linkage between the tractor 12 and beam 14. The hitch beams 42 are each rotatably coupled to the cat hitch 44 of the tile plow 10 at one end and the beam 14 at the other end. Two hydraulic cylinders 46 are each pivotally coupled at one end to the beam 14 and at the other end to one of the hitch beams 42.

The rear portion 18 is comprised of a wheel assembly 48 and a rear linkage 50. Similar to the front linkage formed by the hitch beams 42, the rear linkage 50 includes two parallel beams 52 which are pivotally coupled at one end to the beam 14 and rigidly coupled to a transverse beam 54 at the other end. Two cross braces 56 are welded to each of the beams 52 for strength. Two hydraulic cylinders 58 are pivotally mounted at one end to the top of the beam 14 and at the other end to a bracing assembly 60 comprised of five strips of half inch by four inch steel welded to the beams 52 and transverse beam 54. The wheel assembly 48 is comprised of two sets of two wheels 62 mounted to a spacer 64. The spacer 64 is rotatably mounted to the transverse beam 52 The combination of the transverse beam 52, the spacers 64 and the wheels 62 forms a four wheeled base coupled to the rear linkage 50.

When the hydraulic cylinders 46 and 58 are retracted, the beam 14 is lowered such that the tile plow 10 moves to the lowered plowing position shown in FIG. 2. In contrast, when the hydraulic cylinders 46 and 58 are extended, the beam 14 is raised so that the tile plow 10 moves to the raised transport position shown in FIG. 1. The front linkage also serves the purpose of keeping the tile plow 10 upright if the wheels 62 are raised inadvertently while the tile plow 10 is stationary.

When the tile plow 10 is in the raised position shown in FIGS. 1 and 3, the shoe 20 is above ground level and the tile plow 10 can be transported or moved to the starting point in the field to be tiled. When the tile plow 10 is lowered to the lowered position shown in FIGS. 2 and 4, the shoe 20 will be lowered into the ground as shown in FIG. 2. In this position, the tile plow can be used to dig a trench and lay tile as shown in FIG. 2 and as described below.

When the tile plow 10 is in the lowered position (FIGS. 2 and 4), the length of the tile plow spans approximately 22 feet in the preferred embodiment. Also, the distance from the hitch 44 to the beam 14 is the same as the distance from the wheel assembly 48 to the beam which keeps the tile plow 10 level while it is moved between the raised and lowered positions. The long length of the tile plow in the lowered position, in combination with the wide wheel span of the rear wheel assembly 48 (preferably 120 inches from center to center of the wheels 62), results in performance superior to the prior art. The wide wheel span provides clearance between the wheels 62 and the plowed trench which keeps the wheels 62 from running over uneven terrain caused by the tile plow 10. Spacing the wheels 62 apart by 120 inches also allows the tile plow to travel through 30 inch corn rows.

The wheel assembly 48 is a carriage system that is located well behind the shoe 20 when the plow 10 is in the lowered position. This transfers more weight to the draw bar of the tractor, which increases traction. The position of the wheel assembly 48 also enables the shoe 20 of the plow 10 to maintain a more consistent level grade while the wheels 62 go over uneven terrain behind the shoe 20. In the lowered position, the tile plow has a very narrow profile in the middle of the plow 10. This can best be seen in the top view of FIG. 4. Therefore, the flow of disturbed soil under the main horizontal beam 14 is less restricted than with prior art tile plows.

Figure 7:
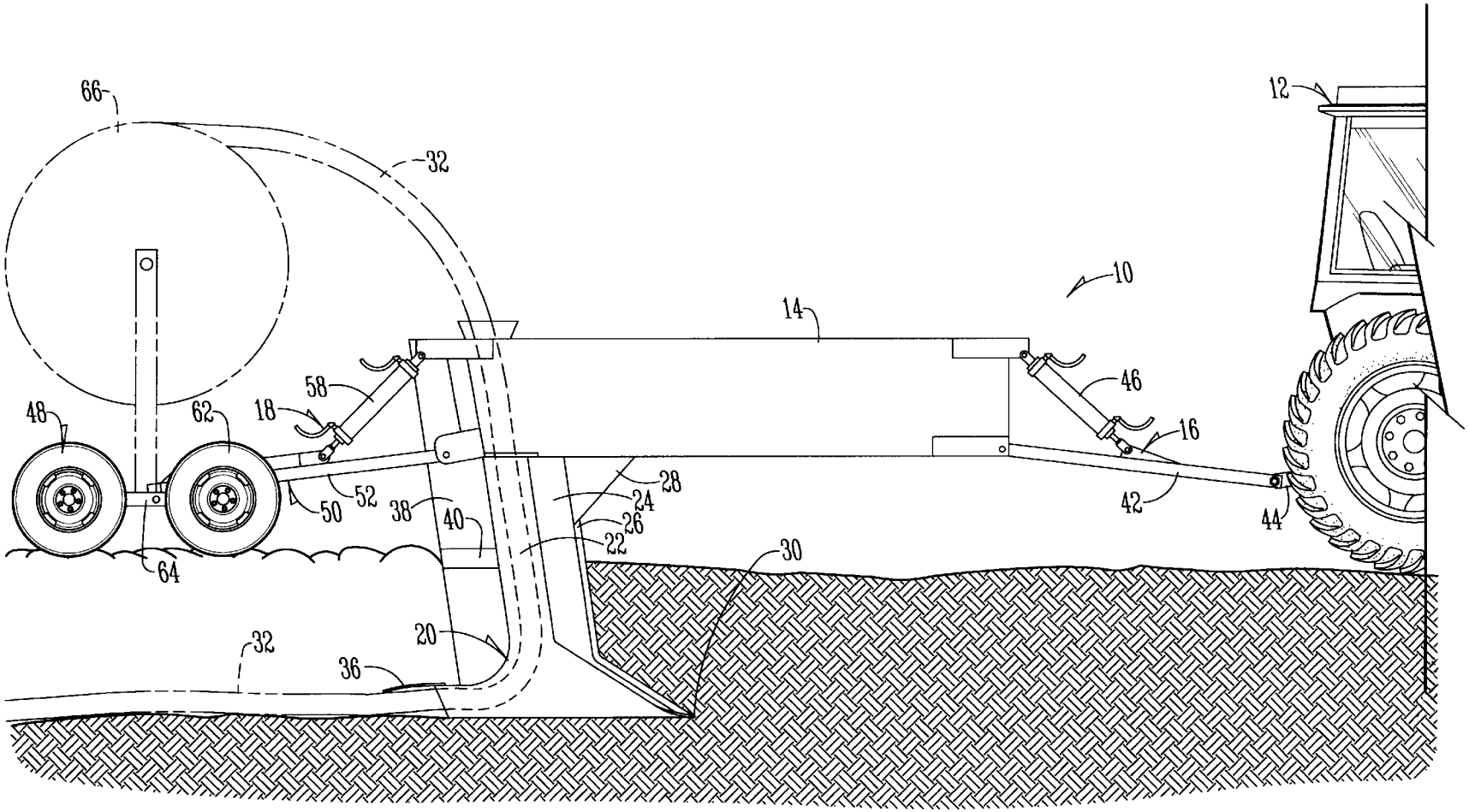
FIG. 7 is a side view of an alternative embodiment of the tile plow of the present invention attached to a tractor in a lowered plowing position, with a tile reel and tile shown in broken lines.

The figures show at least two alternative methods of feeding tile 32 into the tile plow 10. FIG. 7 shows a coil or reel 66 which is coupled to the transverse beam 54 of the wheel assembly 48. In this example, as the tile plow 10 moves through the field, tile 32 will be fed through the channel in the shoe 20 and beam 14 and will simply unwind from the coil 66. Another example of a method for feeding coil into the tile plow 10 is shown in FIGS. 2 and 3. Before tiling, the tile 32 is simply laid out on the ground along the path to be tiled. As the tractor and tile plow 10 move through the field, the tile 32 is fed into the channel from the ground. To prevent the tile 32 from becoming tangled with the wheels of the tractor or tile plow, a tile guide 68 (FIG. 3) is provided which extends from the beam 14 and has an upward facing U-shaped guide and cover that allows the tile 32 to pass through as it is fed into the channel of the tile plow 10. Of course, various other methods of feeding tile 32 into the tile plow 10 can be used.

Figure 6:
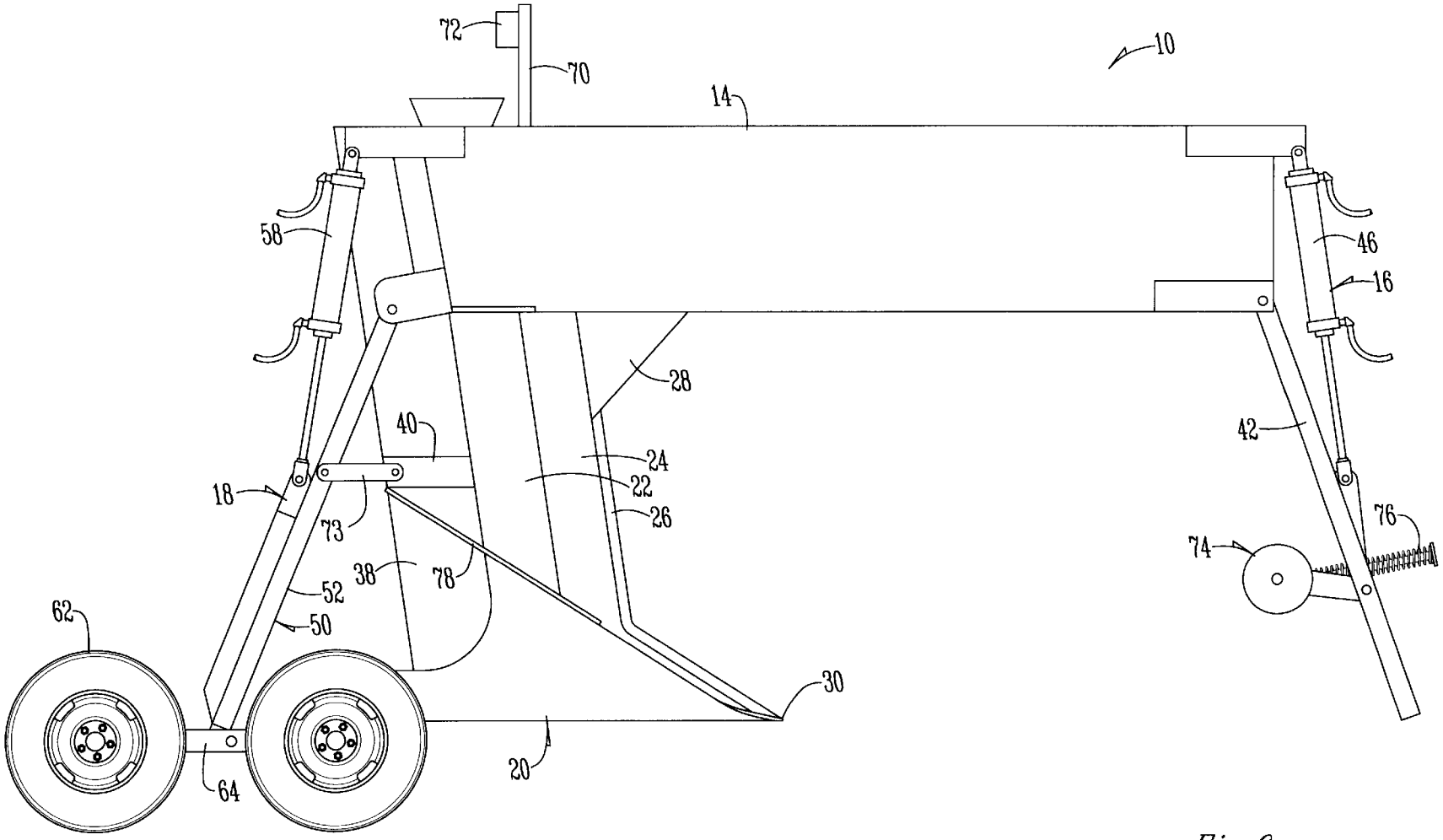
FIG. 6 is a side view of an alternative embodiment of the present invention.

FIG. 6 shows an alternate embodiment of the plow with accessories. Mounted to the beam 14 above the shoe 20 is a laser bracket 70 which is adapted to hold a laser receiver 72 which can be used to control the level or depth of the trench created by the shoe 20. If the laser receiver 72 is used, the tile plow 10 could include an electric-over-hydraulic valve to automatically control the level or depth. In addition, a similar laser receiver could be used to the front of the beam 14 (not shown). FIG. 6 also shows a locking member 73 which is coupled to the rear linkage 50 and is coupled by a pin to the brace 40 of the sheet 48. The locking member 73 is used to securely hold the rear portion 18 of the tile plow 10 in the transport position shown in FIG. 6. This allows the tile plow to be safely transported and stored.

FIG. 6 also shows a disc coulter 74 pivotally attached to the hitch beams 42. The disc coulter 74 is spring loaded such that a spring 76 biases the disc coulter 74 to the position shown in FIG. 6. When the tile plow 10 is in the lowered position shown in FIG. 2, the disc coulter 74 will cut debris on the ground ahead of the shoe 20 to help prevent the plow 10 from becoming plugged up.

FIG. 6 also shows a removable cutting edge extension 78. One problem encountered with all prior art tile plows is that the user may be unaware when an existing tile line is cut. The extensions 78 extend the angled cutting edge of the shoe 20 around the main vertical tube 22 of the shoe 20 in order to bring some dirt to the surface where broken tile chips can be identified by the user. In this way, while creating new tile lines with the tile plow 10, the user can identify where an existing tile line has been cut and therefore can be repaired. An extension 78 is mounted to each side of the shoe 20. Each extension is approximately 3 inches wide, 1 inch thick, and is angled as shown in FIG. 6. The extensions 78 are preferably bolted to the shoe 20 so that they can be removed when there is no concern in cutting existing tile lines. An alternative method of identifying cut existing tile lines is to extend the horizontal beam 14 so that the entire shoe 20 can be angled to lift soil at least four feet. If the tile chips are visible at the surface it would then be easy to locate the old tile line with a back hoe.

Figure 8:
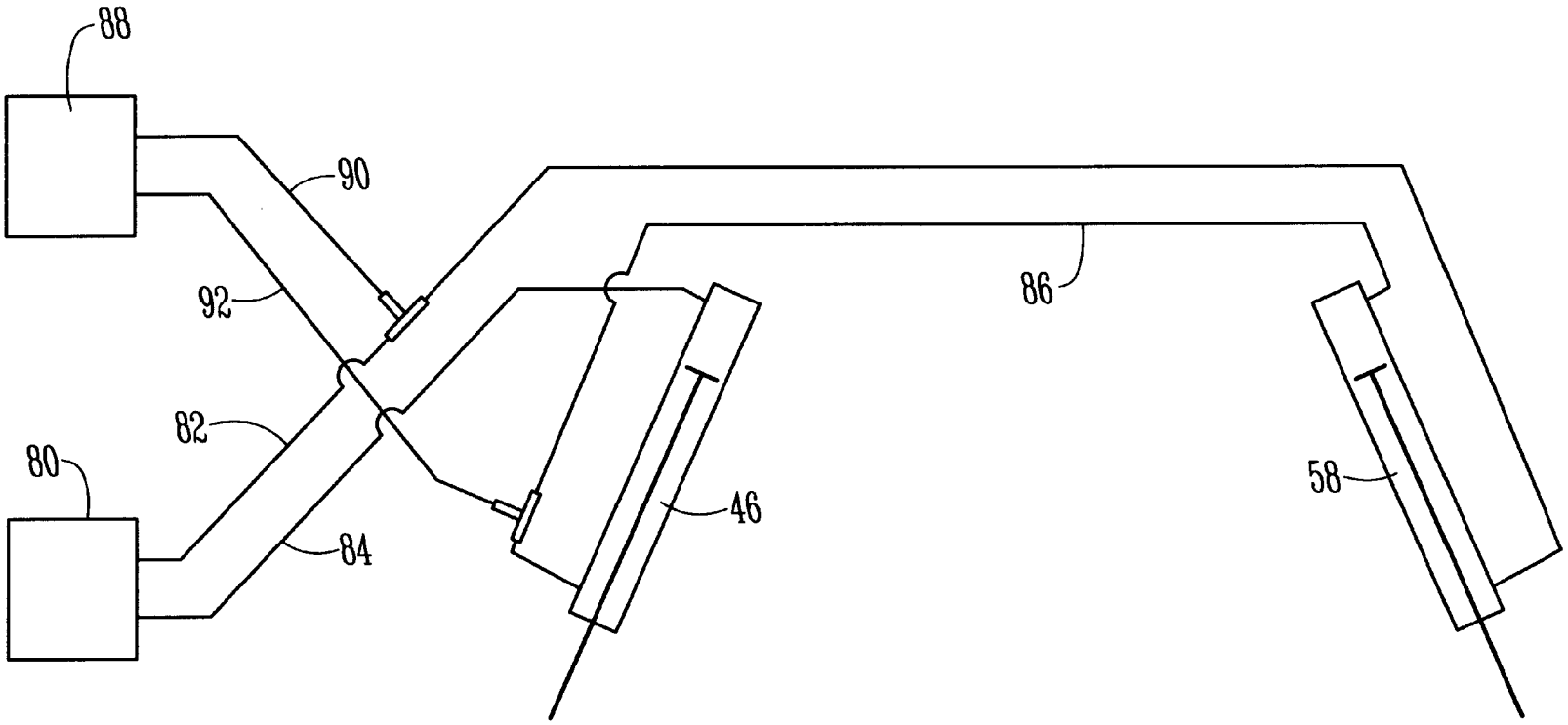
FIG. 8 is a hydraulic schematic diagram showing the hydraulic system of the present invention.

FIG. 8 is a hydraulic schematic diagram illustrating the hydraulic system of the present invention. As shown, a primary hydraulic outlet 80 operates both the front and back hydraulic cylinders 46 and 58 via hydraulic lines 82 and 84, respectively. The configuration shown in FIG. 8 operates as a slave system. When the tile plow 10 is raised or lowered via the primary hydraulic outlet 80, the discharge from the front cylinders 46 (via hydraulic line 86) operates the rear cylinders 58 so as to keep the tile plow 10 level. A second hydraulic outlet 88 is used to adjust the position of the rear cylinders 58 in relation to the front cylinders 46. The second hydraulic outlet 88 is connected to hydraulic lines 90 and 92 which are teed into the hydraulic lines 82 and 86 respectively. In this way, if the user wishes to change the pitch of the plow shoe 20, the second hydraulic outlet 88 will cause the rear cylinders 58 to adjust relative to the front cylinders 46. Since the rear cylinders 58 operate by the displaced oil from the front cylinders 46, the front cylinders 46 are sized so that the ram end displacement equals the non-ram displacement of the rear cylinders 58. In the preferred embodiment, the front cylinders 46 are comprised of 4"×30" cylinders. The rear cylinders 58 are preferably comprised of 4"33 24" cylinders. Of course, different sizes and different numbers of cylinders could be used with the present invention.

The tile plow of the present invention operates as follows.

To hitch the tile plow 10 to a tractor 12 or bulldozer, etc., the user simply connects the hitch 44 of the tile plow 10 to the draw bar of the tractor via a pin. The user then simply connects four hydraulic hoses and an electric supply plug (for any signal lights that are used or for the laser receiver, if used). The process of hooking the tile plow 10 to the tractor normally takes only a few minutes.

Typically, when laying tile lines in a field, a user will use a back hoe to dig a hole in order to tap into existing tile lines. Once the hole is created with the back hoe, the user can drive the tractor 12 and the tile plow 10 in the raised position (FIG. 1) over the hole until the shoe 20 is positioned directly above the hole. The user then activates the primary hydraulic outlet 80 which retracts both the front and rear hydraulic cylinders 46 and 58 and lowers the tile plow 10 to the lowered position (FIG. 2) so that the shoe 20 is disposed within the hole created by the back hoe. Alternatively, the tractor 12 is driven slowly forward while the beam 14 and shoe 20 are lowered so that the shoe gradually plows downwardly to the desired depth. The tile 32 is then fed through the channel formed in the tile plow 10 as described above until it can be pulled out through the opening 34. Once the tile 32 is fed through the channel, the tile plow 10 is ready to lay the tile. The tile 32 to be laid is either laid on the ground along the path or wound on the coil 66 as described above. Once the user starts to pull the tile plow 10, the cutting edge 30 of the shoe 20 as well as the blade 26 of the shoe 20 will begin to create a trench for the tile 32 to be laid into. As the tile plow 10 travels through the field, the tile 32 will be laid in the bottom of the trench as shown in FIG. 2. As the user is laying tile lines, the pitch of the shoe 20 can be adjusted by activating the second hydraulic outlet 88 to adjust the rear cylinders 58 relative to the front cylinders 46. As the tile plow 10 moves through the field, any bumps encountered by the wheels of the tractor or the wheels 62 of the tile plow, will have little effect on the level of the shoe 20 because of the placement of the wheels behind the shoe, and because of the distance between the shoe and the wheels.

If the extensions 78 are attached to the shoe 20 (FIG. 6), the extensions will bring a cross section of soil and residue to the surface as the tile plow 10 moves through the field. This enables the operator to see any debris that would indicate that an old tile line had been cut in the plowing process. If the optional disc coulter 74 is used (FIG. 6), the coulter 74 will cut debris on the surface of the field in front of the shoe 20 to prevent any plugging of the plow 10. If the laser receiver 72 is used (FIG. 6), the pitch and depth of the tile plow 10 can be automatically controlled by the laser receiver.

Once the user reaches the end of the tile line, the tile plow 10 is raised to the raised position simply by activating the primary hydraulic outlet 80 which causes the cylinders 46 and 58 to raise the shoe 20. To unhitch the tile plow 10 the user simply unhooks the four hydraulic lines, the electrical supply plug, and removes the hitch pin. Preferably, a jack (not shown) may be coupled to the hitch beams 42 to simplify the hitching and unhitching process.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A tile plow for attaching to a vehicle comprising:

a beam;

a shoe coupled to the beam for digging a trench;

a first hydraulic cylinder coupled to the beam for pivotally adjusting the height of the beam at a first location;

a second hydraulic cylinder coupled to the beam for pivotally adjusting the height of the beam at a second location;

a first hydraulic outlet for supplying hydraulic power to the first and second hydraulic cylinders to pivotally adjust the height of the beam at the first and second locations; and a second hydraulic outlet for supplying hydraulic power to the second hydraulic cylinder to pivotally adjust the height of the beam at the second location relative to height of the beam at the first location.

2. The tile plow according to claim 1 further comprising:

the beam having a front and back end;

a front assembly pivotally coupled to the front end of the beam and adapted to be attached to the vehicle, said pivotal coupling being pivotal about a horizontal axis; and a wheel assembly pivotally coupled to the back end of the beam for pivotal movement about a horizontal axis such that the beam and shoe are pivotally moveable between a raised position and a lowered position when the wheel assembly is pivoted relative to the beam, and wherein the wheel assembly is positioned behind the shoe when the tile plow is in the lowered position.

3. The tile plow of claim 2 wherein the shoe extends downward from the beam at an angle to create a lifting action while digging a trench.

4. The tile plow of claim 2 wherein the front assembly is movable with the wheel assembly such that the tile plow can be moved between the raised and lowered positions while maintaining a substantially horizontal orientation of the beam and shoe.

5. The tile plow of claim 1 further comprising a means for adjusting the second hydraulic cylinder relative to the first hydraulic cylinder.

6. The tile plow of claim 5 wherein the first and second hydraulic cylinders are powered by a primary hydraulic outlet and wherein the means for adjusting the second hydraulic cylinder is comprised of a secondary hydraulic outlet.

7. The tile plow of claim 1 further comprising a flap coupled to and extending rearwardly from the shoe.

8. The tile plow of claim 1 wherein the second hydraulic cylinder is powered from the discharge of the first hydraulic cylinder.

9. The tile plow of claim 1 further comprising a wheel assembly connected to the second hydraulic cylinder and to the beam for rollably supporting the beam above the ground.

10. The tile plow of claim 1 further comprising a support assembly connected to the first hydraulic cylinder and to the beam and being adapted to secure the beam to the vehicle.

11. The tile plow according to claim 1 further comprising:

the beam having forward and rearward ends;

a front beam support assembly pivotally connected to the front end of the beam; and a rear beam support assembly pivotally connected to the rear end of the beam.

12. The tile plow of claim 11 wherein the first hydraulic cylinder is connected between the beam and the front beam support assembly and the second hydraulic cylinder connected between the beam and the rear beam support assembly.

13. The tile plow of claim 12 wherein the first and second cylinders are hydraulically coupled.

14. The tile plow of claim 13 wherein the first and second cylinders are adjustable relative to one another.

15. The tile plow of claim 12 wherein the beam is raised when the first and second cylinders are extended and the beam is lowered when the first and second cylinders are retracted.

16. A tile plow for attaching a vehicle comprising:

an elongated beam having a front and back end;

a front assembly pivotally coupled to the front end of the beam and adapted to be attached to the vehicle, said pivotal coupling being pivotal about a horizontal axis;

a shoe extending downwardly from the beam for digging a trench;

a wheel assembly pivotally coupled to the back end of the beam for pivotal movement about a horizontal axis such that the beam and shoe are pivotally moveable between a raised position and a lowered position when the wheel assembly is pivoted relative to the beam, and wherein the wheel assembly is positioned behind the shoe when the plow is in the lowered position; and an elongated cutting edge extension coupled to the shoe and disposed at an angle relative to a ground surface for the drawing debris from the trench created by the shoe to the top of the ground surface for identifying broken tile.

* * * * *